US007212393B2

(12) United States Patent
Gefter et al.

(10) Patent No.: US 7,212,393 B2
(45) Date of Patent: May 1, 2007

(54) AIR IONIZATION MODULE AND METHOD

(75) Inventors: Peter Gefter, South San Francisco, CA (US); Scott Gehlke, Berkeley, CA (US); Alexander Ignatenco, Hayward, CA (US)

(73) Assignee: Ion Systems, Inc., Berkeley, CA (US)

( * ) Notice: Subject to any disclaimer, the term of this patent is extended or adjusted under 35 U.S.C. 154(b) by 247 days.

(21) Appl. No.: 10/956,189

(22) Filed: Sep. 30, 2004

(65) Prior Publication Data

US 2006/0072279 A1 Apr. 6, 2006

(51) Int. Cl.
*H01T 23/00* (2006.01)

(52) U.S. Cl. ..... 361/230

(58) Field of Classification Search ..... 361/230
See application file for complete search history.

(56) References Cited

U.S. PATENT DOCUMENTS 3,534,530 A * 10/1970 Hornig ..... 96/88
3,699,387 A * 10/1972 Edwards ..... 361/230
4,253,852 A * 3/1981 Adams ..... 96/58
4,417,293 A * 11/1983 Larigaldie ..... 361/212
4,757,422 A * 7/1988 Bossard et al. ..... 361/231
5,403,383 A * 4/1995 Jaisinghani ..... 95/69
5,647,890 A * 7/1997 Yamamoto ..... 95/69
6,785,114 B2 * 8/2004 Gorczyca et al. ..... 361/231
2004/0012909 A1 * 1/2004 Gorczyca et al. ..... 361/231

* cited by examiner

*Primary Examiner*—Stephen W. Jackson
*Assistant Examiner*—Scott Bauer
(74) *Attorney, Agent, or Firm*—Fenwick & West LLP

(57) ABSTRACT

An air ionizing module and method for generating ions of one and opposite polarities within a flowing stream of air or other gas includes a thin-filament electrode mounted within the flowing stream in regions thereof of maximum flow velocity. The thin-filament electrode is mounted in a multi-sided polygonal configuration to receive high ionizing voltage of alternating one and opposite polarities to form an intense stream of ions toward an electrically-isolated reference electrode positioned upstream of the filament electrode. Another reference electrode positioned within the flowing stream downstream of the filament electrode receives a bias voltage of selected polarity to control the quantities of generated ions of positive and negative polarities in an outlet stream of the ions and flowing gas.

21 Claims, 5 Drawing Sheets

B

A

AIR IONIZATION MODULE AND METHOD

FIELD OF THE INVENTION

This invention relates to apparatus and method for producing an air stream containing substantially balanced quantities of positive and negative air ions for neutralizing static charge on a charged object.

BACKGROUND OF THE INVENTION

Certain known static-charge neutralizers commonly operate on alternating current (AC) applied to a step-up transformer for producing high ionizing voltages applied to sharp-tipped electrodes. Ideally, operation of such a neutralizer should produce a moving air stream of electrically balanced quantities of positive and negative ions that can be directed toward a proximate object having an undesirable static electrical charge that must be neutralized.

Various electrical circuits are known for substantially balancing the quantity of positive and negative ions transported in a moving air stream using biased control grids, floating power supplies, and the like. However, such conventional balancing circuits commonly include bulky transformers and lack capability for manual balancing or offsetting adjustments.

In addition, conventional ionizers exhibit low efficiency of ion generation and erosion of the emitter electrodes attributable to high current densities at electrode tips, with concomitant particulate contamination attributed to eroded electrode tips. Electrodes formed of titanium or silicon may reduce the rates of electrode erosions that contribute to reductions in ion-generating efficiencies with time, but eventual replacements of eroded electrodes in complex installations promote prohibitively expensive maintenance requirements.

Accordingly, it is desirable to efficiently produce balanced quantities of air ions in a flowing air stream with low-maintenance equipment that can be readily serviced as well as conveniently adjusted for offset control and manual balancing.

SUMMARY OF THE INVENTION

In accordance with one embodiment of the present invention, an ionizing module operates on applied AC to efficiently produce a substantially balanced flowing stream of positive and negative air ions that can be directed toward a statically-charged object, or into an environment of unbalanced air ions that is to be neutralized. An ionizing electrode includes a thin wire shaped as a closed figure within regions of an air stream of maximum flow velocity, and reference electrodes are disposed at generally different distances upstream and downstream of the ionizing electrode to enhance ion-generation efficiency and balance control. A high-voltage power supply circuit is connected to the ionizing electrode and is tapped for low voltage to supply as bias to the down-stream reference electrode. An outlet structure of insulating material is disposed within the flowing air stream to aid in balancing the positive and negative ions flowing in the air stream.

DETAILED DESCRIPTION OF THE INVENTION

Figure 1:
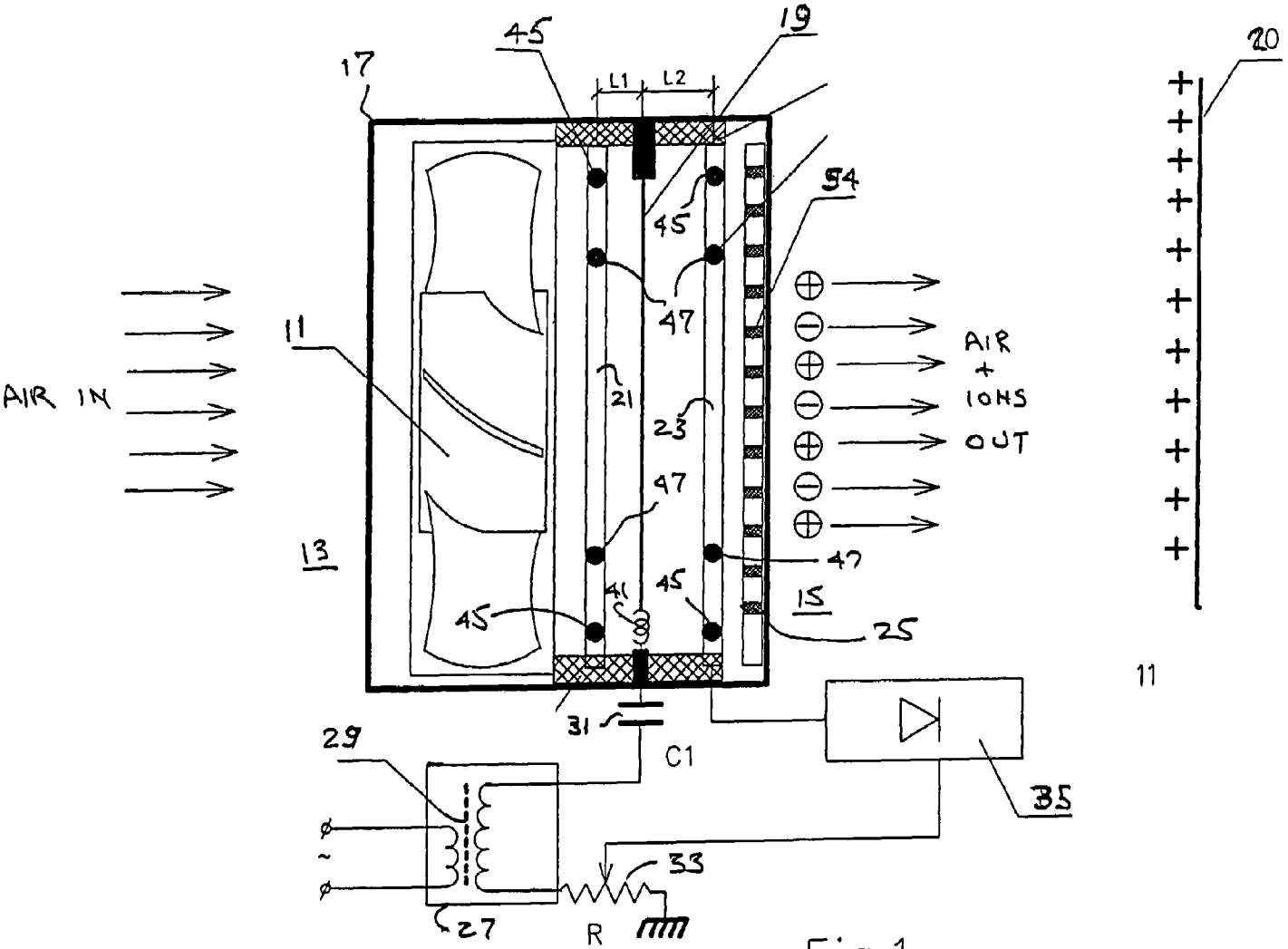
FIG. 1 is a pictorial side illustration of apparatus and circuitry in accordance with one embodiment of the present invention.

Referring now to the pictorial side illustration of FIG. 1, there is shown a fan 11 disposed to rotate the fan blades about a longitudinal axis that substantially aligns between input and output ports 13, 15 of a supporting housing 17. An ionizing electrode 19, as described in detail later herein, is supported within the insulating housing 17 at a location downstream of the fan 11. A pair of reference electrodes 21, 23 are supported within the insulating housing 17 generally at different distances upstream and downstream relative to the ionizing electrode 19. An insulating grid structure 25 is disposed across the outlet port 15 to pass a flowing air stream containing positive and negative ions therethrough toward a charged object 20 to be neutralized of static charges.

A high-voltage power supply 27 includes a step-up transformer 29 having one terminal of a secondary winding connected to the ionizing electrode 19 through a capacitor 31, and having another terminal of the secondary winding connected to ground through an adjustable voltage divider, or potentiometer 33. An adjustable AC voltage derived from the voltage divider 33 is rectified 35 and applied as a DC bias voltage to the downstream reference electrode 23. Of course, a power supply that switches recurringly between high ionizing voltages of one polarity and opposite polarity may alternatively energize the ionization electrode 19. The electrodes 19, 21, 23 are all electrically insulated from ground as supported within the insulating housing 17.

Figure 4:
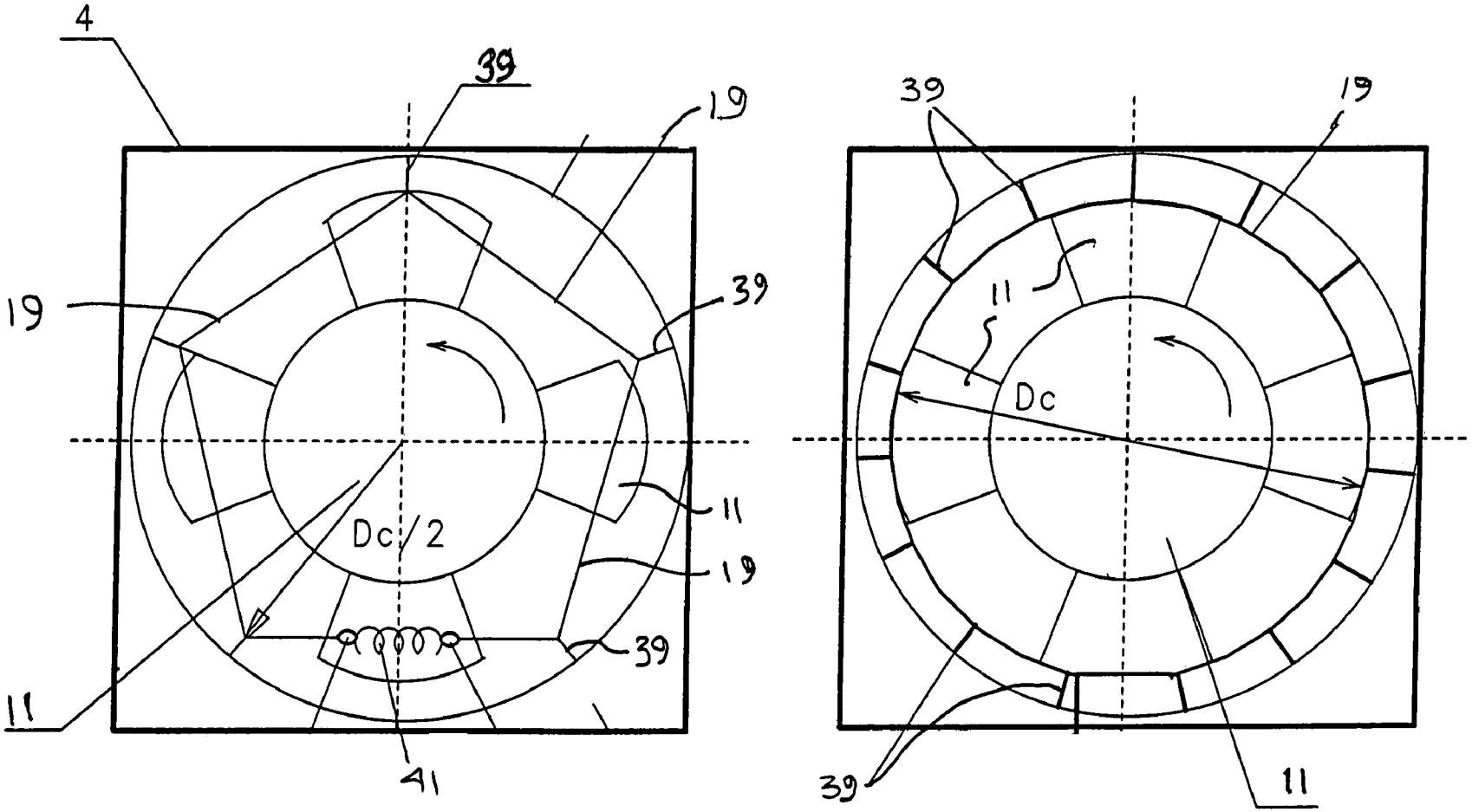
FIGS. 4A, 4B are frontal pictorial illustrations of various embodiments of ionizing electrodes in accordance with the present invention.
Figure 5:
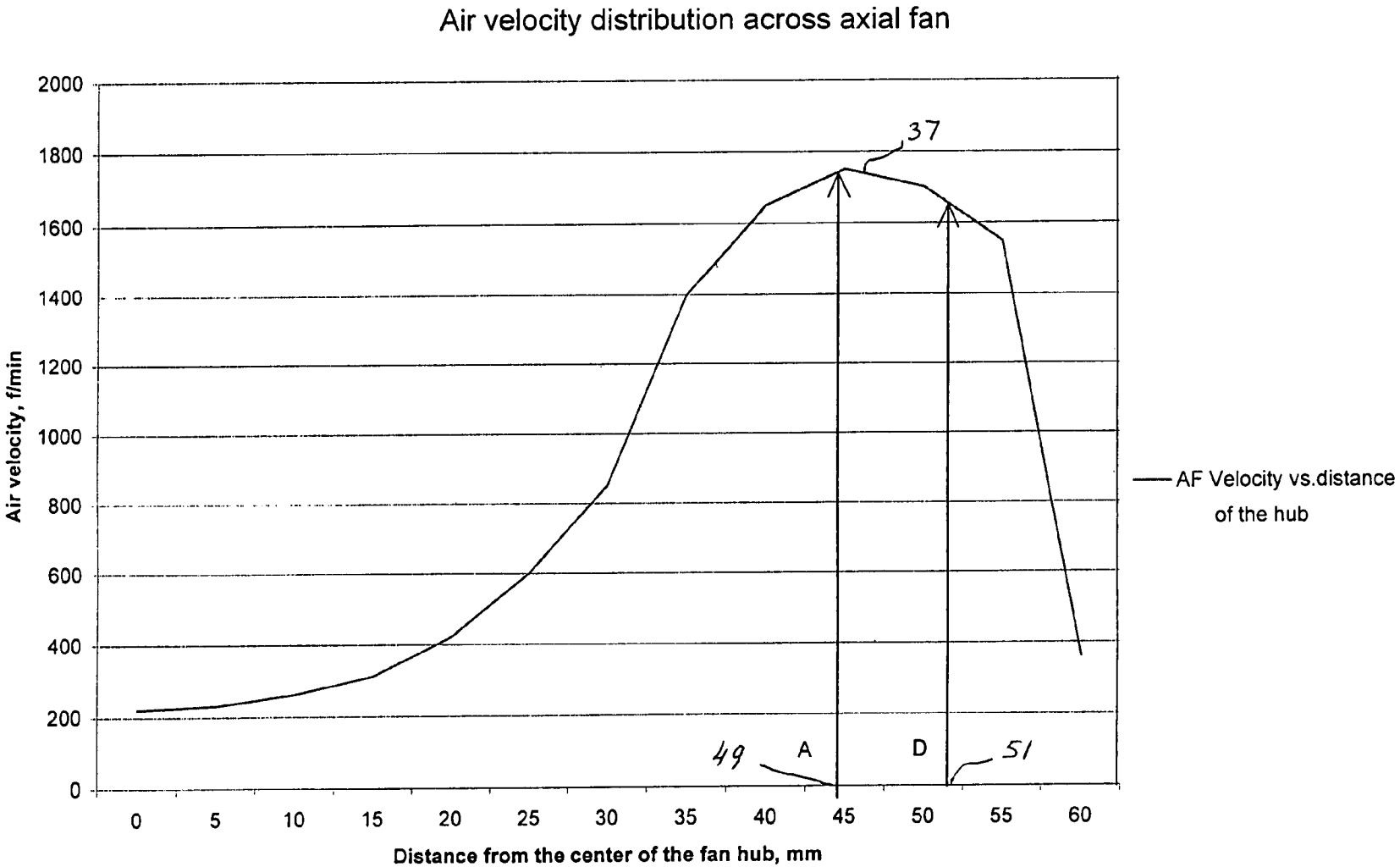
FIG. 5 is a graph illustrating regions of an air stream from a radial fan at which flow velocities are greatest for use in accordance with the present invention.

In operation, air flows into the housing 17 through the inlet port 13 in response to rotation of the fan 11 about the rotational axis that is substantially aligned between the inlet and outlet ports 13, 15. As illustrated in the graph of FIG. 5, maximum flow velocity 37 of air established by the radial blades of fan 11 occurs at a selected displacement radially from the rotational axis of the fan 11. Accordingly, the ionizing electrode 19 is disposed as a substantially continuous thin conductive filament within the region of maximum airflow velocity, as shown in FIGS. 4A, 4B. The thin filament or wire 19 is formed of tungsten or stainless steel or a gold-plated composite structure including such materials, with a diameter in the range of about 20–200 microns, and preferably in the range of about 50–60 microns to provide sufficient mechanical strength while promoting high ionizing electric field intensity along the entire length of the ionizing electrode 19. The ionizing electrode 19 is supported within the insulating housing 17 on a plurality of insulating mounts 39 that form the ionizing electrode in a substantially closed figure, or polygon, with the enclosed area thereof disposed substantially normal to the direction of air flow between inlet and outlet ports 13, 15.

In the embodiment illustrated in FIG. 4B, the mounts 39 support the ionizing electrode wire 19 in a 15-sided polygon configuration approximating a circle at a 'diameter' 37 that closely approximates the diameter at which maximum air flow velocity occurs. In the embodiment illustrated in FIG. 4A, the ionizing electrode wire 19 is supported on fewer (5) mounts 39 to form a distinctive pentagon that is disposed substantially within the region of maximum air flow velocity from fan 11. About 5–7 mounts 39 are preferred for fabrication simplicity and adequate support for the ionizing electrode wire 19 in a substantially closed polygon configuration. In the embodiment illustrated in FIG. 4A, a spring 41 disposed between ends of the electrode wire 19 maintains the electrode wire in tension about substantially rigid mounts 39, and in the embodiment illustrated in FIG. 4B, one or more resilient mounts 39 maintain tension in a loop of the electrode wire 19 that is supported thereby.

Referring again to FIG. 1, there is shown a set of reference electrodes 21, 23 disposed upstream and downstream of the ionizing electrode 19. Each of these reference electrodes 21, 23 may include one or more conductive rings 45, 47 that are mounted concentrically about the axis of rotation of the fan 11, within the region of maximum air velocity produced thereby. Thus, as illustrated in the graph of FIG. 5, the concentric ring electrodes 45, 47 may be supported at about the radii 49, 51 from the axis of rotation of the fan 11, within and about the region of maximum air flow velocity produced thereby.

It should be noted from the illustrated circuitry of FIG. 1 that the upstream reference electrode 21 is not connected (i.e., is at 'floating' potential) and is only loosely capacitively coupled to the nearest electrode 19 via distributed capacitance therebetween. Additionally, the one or more conductive rings 45, 47 in the upstream and downstream reference electrodes 21, 23 are formed of conductors of much thicker diameter, for example, 10 to 100 times the diameter of the ionization electrode wire 19 to assure no ionization from the reference electrodes 45, 47. In addition, the upstream reference electrode 21 is positioned closer to the ionization electrode 19 than the downstream reference electrode 23. This promotes an intense or highly dense flow of generated ions in a direction opposite the air flow through the upstream reference electrode 21 and the ionization electrode 19 for enhanced capture of the generated ions within the flowing air stream. Ions of one polarity that are generated during one half cycle of the AC high voltage applied to the ionization electrode 19 migrate toward the floating reference electrode 21 to charge that electrode 21 toward a static voltage of one polarity. However, ions of the opposite polarity that are generated during the alternate half cycle of the applied AC high voltage migrate toward the floating reference electrode 21 to discharge that electrode 21 and charge that electrode toward a static voltage of opposite polarity.

In steady-state operation, high ion current densities flow between the upstream reference electrode 21 and the ionization electrode 19 for capture within the air stream from fan 11 flowing in the opposite direction, and the potential on reference electrode 21 settles toward approximately zero volts. The spacing of the upstream reference electrode 21 from the ionization electrode 19 is set at a closer distance, $L_1$, than the distance, $L_2$, at which the downstream reference electrode 23 is set from the ionization electrode 19 for enhanced ion current flow within the spacing $L_1$ and improved efficiency of entrainment of the generated ions within the flowing air stream.

Figure 2:
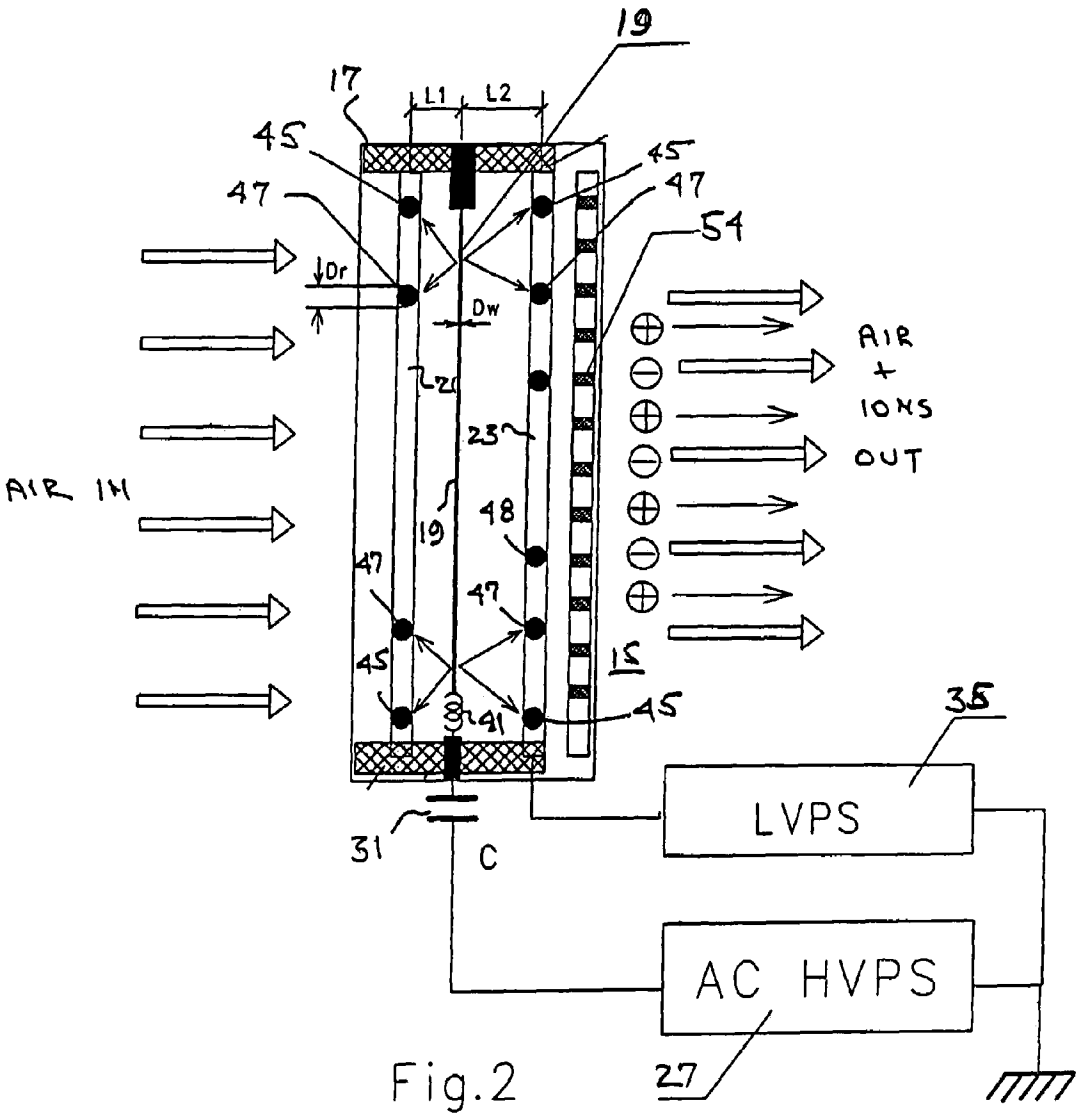
FIG. 2 is a pictorial side illustration of an ionizer cell in accordance with another embodiment of the present invention.
Figure 3:
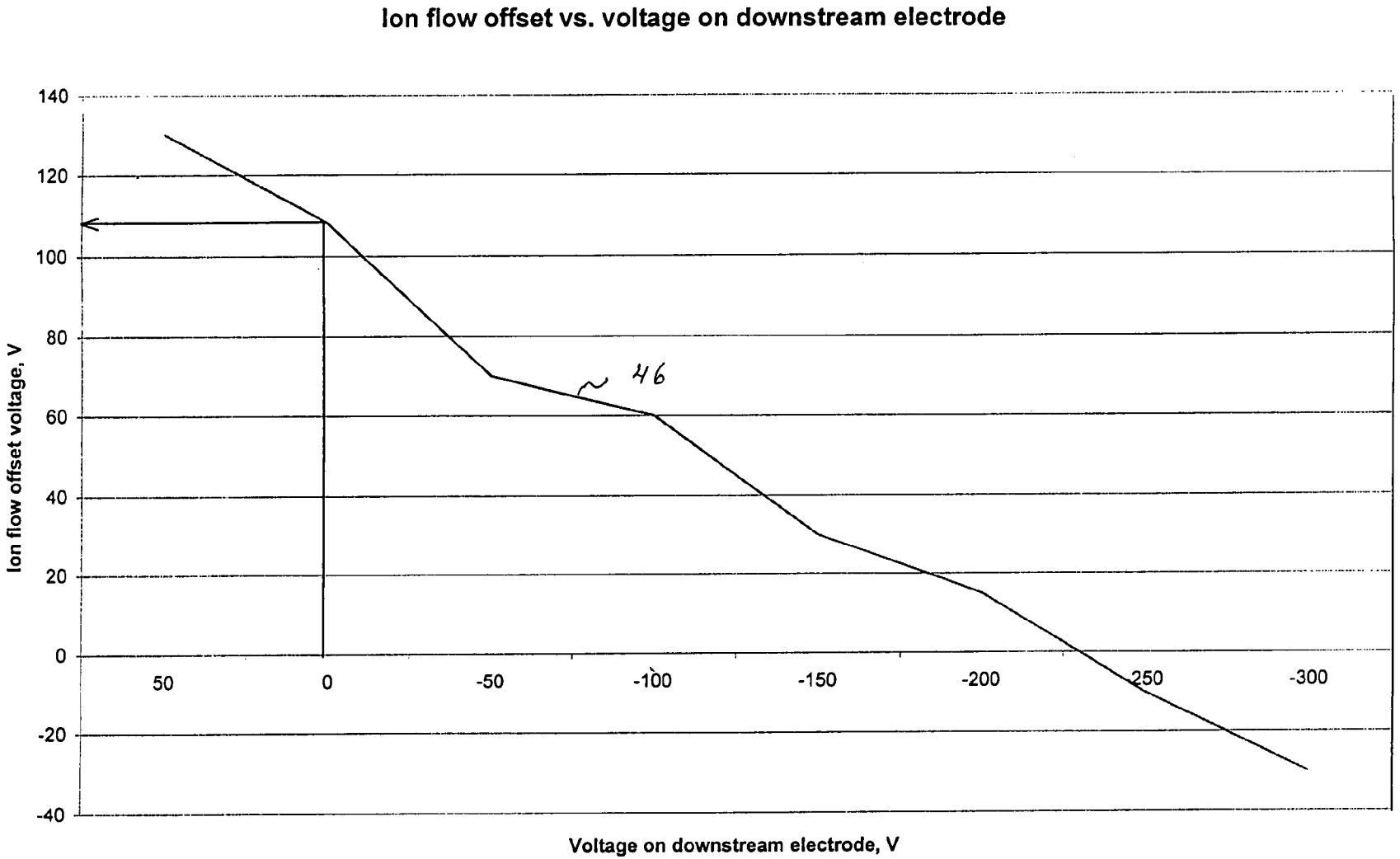
FIG. 3 is a graph illustrating ion-flow offset voltages in the outlet air stream as a function of bias voltage applied to a downstream reference electrode.

The downstream reference electrode 23 is set at a greater distance $L_2$ from the ionization electrode 19 and may include one or more ring-shaped conductors 45, 47 of thick dimension, for example 10 to 100 times the diameter of the ionization electrode wire 19 to avoid high ionizing electrostatic field intensities and resultant ion generation. Instead, the downstream reference electrode 23 is connected to a DC bias supply including the voltage divider 33 connected in the secondary circuit of transformer 29, and rectifier 35. In this way, a DC bias voltage of one polarity (typically, negative) is supplied to the downstream reference electrode 23 to repel an excess of ions of the one polarity (typically, negative due to a greater mobility of negative air ions). In addition, because the voltage divider 33 is connected to conduct current flowing in the secondary winding of transformer 29, higher bias voltage is supplied to the downstream reference electrode 23 on higher current flowing in the secondary winding attributable to higher ion generation in each half cycle of AC high ionizing voltage applied to the ionization electrode 19. In steady-state operation, the DC bias voltage supplied to the downstream reference electrode 23 approximates the voltage (typically of negative polarity) at which balanced quantities of positive and negative ions flow in the air stream through the downstream reference electrode 23. As illustrated in the graph of FIG. 3, such bias voltage may be about −230 volts to establish zero offset or balanced flow of positive and negative ions. As illustrated by the graph of FIG. 3, a substantial positive offset voltage results from operating the downstream reference electrode 23 at zero applied bias. Thus, for balanced flow of generated positive and negative ions through the downstream reference electrode 23, spaced a distance $L_2$ from the ionization electrode 19, a negative DC bias of about −230 volts may be applied to the reference electrode 23 in the illustrated embodiment of the present invention. However, DC bias voltage provided by the voltage divider 33 may be adjusted to provide a wide range of outlet ion flow offset voltages, as desired, approximated by the curve 46 in the graph of FIG. 3. One or more ring-shaped conductors 45, 47, preferably 2–6 conductors in concentric array as shown in FIGS. 2, 3, are disposed within the region of greatest velocity of the flowing air stream. The number of conductors 45, 47 of selected diameter, lying within a substantially common plane at a distance $L_2$ from the ionization electrode 19, relative to the distance $L_1$ of the upstream reference electrode 21 from the ionization electrode 19, affect the bias level required on the downstream reference electrode 23 to establish balanced flow of generated positive and negative ions in the flowing air stream from fan 11. Ideally, the bias supply including rectifier 35 and voltage divider 33 exhibit low output impedance to ground to serve as an electrostatic screen against high ionizing voltage and radiation emission outside of housing 17.

In one embodiment of the present invention, the upstream reference electrode 21 is positioned about 0.2–1.5 inches, and preferably about 0.5 inches, from the ionization electrode 19, and the downstream reference electrode 23 is positioned about 0.3–2 inches, and preferably 0.6–0.75 inches, from the ionization electrode 19, for a ratio of $L_2/L_1$ in the range of about 1.01–1.5, and preferably about 1.15.

Referring now to FIG. 2, there is shown a side pictorial view of the air ionizing module, substantially as shown in FIG. 1 without fan 11. Multiple ones of such modules may be accumulated and positioned within flowing air to distribute generated ions into an environment, for example, associated with a static-free workstation. Such module includes components similar to counterpart components as described herein with reference to FIG. 1 using similar legend numbers. The downstream reference electrode 23 may include additional concentric ring conductors 48, and the high voltage and bias power supplies 27, 35 may be conveniently packaged for installation with each such module. A screen grid 54 formed of insulating material is disposed across the outlet port 15 as a mechanical barrier against inadvertent penetration by external objects into the interior components and structure of the module. Such screen grid of electrically-insulating material may accumulate surface charge of one polarity that then repels and attracts ions of the one and opposite polarities to promote self-balancing of the outlet flow of generated ions.

Therefore, the air ionizing module, or ion generating apparatus, and generation method according to the present invention creates an intense ion flow in a direction opposite to airflow for enhanced efficiency of ion transfer to the air stream. Convenient biasing circuitry adjusts the offset voltage of the outlet ion flow over a range that includes ion balance and ion imbalance of either polarity. Ions are generated along a fine wire electrode instead of at a sharp-tip electrode, for distribution throughout regions of greatest airflow velocity in the flowing air stream. For operation with a fan having radial fan blades rotating about an axis, the fine-wire ionization electrode may be configured as a closed-area polygon or circle supported substantially within a plane oriented normal to the rotational axis of the fan blades for enhanced ion generation and ion transfer to the flowing air stream.

What is claimed is:

1. Ion generating apparatus comprising:

a housing including a channel configured for confining a gas flowing therethrough between an inlet and an outlet;

an ionization electrode disposed within the channel intermediate the inlet and outlet to receive an ionizing voltage thereon;

a source of ionizing voltage connected to the ionization electrode for supplying voltage thereto of one and opposite polarities during alternating recurring intervals;

a first reference electrode disposed within the channel intermediate the inlet and the ionization electrode in electrical isolation; and a second reference electrode disposed within the channel intermediate the ionization electrode and the outlet to receive a bias voltage thereon.

2. Ion generating apparatus according to claim 1 in which the ionization electrode is supported within the channel in a multi-sided polygon bounding an area disposed substantially normal to gas flowing through the channel.

3. Ion generating apparatus according to claim 2 in which the ionization electrode includes a conductive filament positioned among a plurality of support elements.

4. Ion generating apparatus according to claim 3 in which the filament is configured as a loop and at least one of the support elements resiliently tensions the loop about the support elements.

5. Ion generating apparatus according to claim 3 including a resilient member disposed to tension the filament about the plurality of support elements.

6. Ion generating apparatus according to claim 1 in which the first reference electrode is spaced a distance, $L_1$, from the ionization electrode;

the second reference electrode is spaced a distance, $L_2$, from the ionization electrode; and the distance $L_2$ is greater than the distance $L_1$.

7. Ion generating apparatus according to claim 6 in which a ratio of $L_2/L_1$ is within a range of about 1.01 to about 1.5.

8. Ion generating apparatus according to claim 7 in which the ratio of $L_2$/L1 is approximately 1.15.

9. Ion generating apparatus according to claim 1 in which the ionization electrode includes a conductive filament of diameter, Dw; and the first and second reference electrodes include conductors of diameter, Dr, greater than the diameter Dw.

10. Ion generating apparatus according to claim 9 in which the diameter Dw is in the range of about 20 to about 200 microns.

11. Ion generating apparatus according to claim 10 in which a ratio of Dr/Dw is in the range from about 10 to about 100.

12. Ion generating apparatus according to claim 1 comprising:

a source of bias voltage connected to the second reference electrode for supplying DC bias voltage thereto to alter a ratio of positive and negative generated ions passing therethrough.

13. Ion generating apparatus according to claim 12 in which the connection of the source of ionizing voltage to the ionization electrode includes a capacitor connected therebetween.

14. Ion generating apparatus according to claim 2 including a fan disposed with respect to the channel for flowing a stream of gas through the channel;

the first and second reference electrodes each including a number of ring conductors disposed within the cross section of the channel at positions therein of substantially maximum velocity of gas flowing therethrough.

15. Ion generating apparatus according to claim 14 in which the first and second reference electrodes each include a plural number of ring conductors in substantially concentric array located within the cross section of the channel at positions of substantially maximum velocity of gas flowing therethrough.

16. Ion generating apparatus according to claim 14 in which the ionization electrode is supported within the cross section of the channel substantially at positions therein of maximum velocity of gas flowing therethrough.

17. Ion generating apparatus according to claim 1 in which the ionization electrode and the first and second reference electrodes are configured within the housing to form an individual module.

18. A method of generating ions in a flowing stream of a gas, comprising the steps for:

electrically isolating a first conductive electrode to pass the flowing stream of gas therethrough;

supplying ionizing voltage of recurringly alternating polarity to a second conductive electrode disposed downstream of the first electrode to generate ions of one and opposite polarities flowing in the stream of gas passing therethrough; and supplying DC bias voltage to a third conductive electrode disposed downstream of the second electrode to control the volumes of generated positive and negative ions flowing in the stream of gas passing therethrough.

19. The method according to claim 18 including positioning the second electrode substantially within the regions of maximum velocity of the gas in the flowing stream.

20. The method according to claim 19 in which positioning includes mounting a conductive filament as a multi-sided polygon within the regions of maximum velocity of the gas in the flowing stream.

21. Ion generating apparatus comprising:

a housing including a channel configured for confining a gas flowing therethrough between an inlet and an outlet;

an ionization electrode disposed within the channel intermediate the inlet and outlet to receive an ionizing voltage thereon;

a first reference electrode disposed within the channel intermediate the inlet and the ionization electrode in electrical isolation;

a second reference electrode disposed within the channel intermediate the ionization electrode and the outlet to receive a bias voltage thereon;

a source of ionizing voltage connected through a capacitor to the ionization electrode for supplying voltage thereto of one and opposite polarities during alternating recurring intervals, the source of ionizing voltage including a step-up transformer having a primary winding for receiving alternating current supplied thereto, and having a secondary winding with end terminals, with a voltage divider connecting an end terminal of the secondary winding to ground reference, and the capacitor connecting another end terminal to the ionization electrode; and a source of bias voltage connected to the second reference electrode for supplying DC bias voltage thereto to alter a ratio of positive and negative generated ions passing therethrough, the source of bias voltage being connected to the voltage divider for receiving therefrom a selectable alternating voltage for producing the DC bias voltage therefrom.

* * * * *